United States Patent [19]

Tominaga et al.

[11] Patent Number: 4,637,354

[45] Date of Patent: Jan. 20, 1987

[54] V TYPE MOTORCYCLE ENGINE AND TRANSMISSION

[75] Inventors: Nobuyoshi Tominaga, Hamamatsu; Nobuyoshi Kurai, Iwata; Hajime Ueno, Shizuoka; Sadahide Suzuki, Iwata, all of Japan

[73] Assignee: Yamaha Hatsudoki Kabushiki Kaisha, Iwata, Japan

[21] Appl. No.: 236,614

[22] Filed: Feb. 20, 1981

[30] Foreign Application Priority Data

Feb. 23, 1980 [JP] Japan ..... 55-21916

[51] Int. Cl.[4] ..... F02B 75/22; F02F 7/00

[52] U.S. Cl. ..... 123/55 VF; 123/195 R; 180/219

[58] Field of Search ..... 123/55 VF, DIG. 8, 195 R; 180/219

[56] References Cited

U.S. PATENT DOCUMENTS 3,200,804 8/1965 Hensler et al. ..... 123/195 R 4,226,296 10/1980 Higaki ..... 180/219

FOREIGN PATENT DOCUMENTS 1149988 4/1969 United Kingdom ..... 123/DIG. 8

*Primary Examiner*—Craig R. Feinberg

*Attorney, Agent, or Firm*—Donald D. Mon; David O'Reilly

[57] ABSTRACT

A motorcycle has a V type engine with its cylinders inclined other than vertically or horizontally, with a crankshaft extending transversely on the cylinders lying in a forwardly-directed vertical plane. A transmission is mounted to the motorcycle rearwardly of the engine, and has a main shaft adjacent to the crankshaft with its axis rearwardly of and at an elevation beneath the axis of the crankshaft. Stud bolts screw into the crankcase, the arrangement of the shafts enabling the wall thickness of the crankcase to be locally increased to provide for sufficient strength of threads without creating interference with the gears on the main shaft.

1 Claim, 2 Drawing Figures

V TYPE MOTORCYCLE ENGINE AND TRANSMISSION

FIELD OF THE INVENTION

The present invention relates to a V-engine of a motorcycle, in which respective cylinders are arranged such that they are inclined in the longitudinal direction.

BACKGROUND OF THE INVENTION

Among the engines to be installed on a motorcycle, there is the so-called "tandem V-engine", in which respective cylinders are inclined in the longitudinal direction. In this tandem v-engine, the power transmission mechanism of a drive system such as a reduction gear mechanism is disposed at the back of a crankshaft. According to the prior art, the front cylinder is inclined close to a horizontal position, whereas the rear cylinder is positioned close to an upright position so that it may be free from interference with the main shaft of the reduction gear mechanism. More specifically, the stud bolts for fixing the cylinder block of the rear cylinder to the crankcase have to be screwed deeply into the crankcase in order to have a sufficient strength, and the inner wall of the crankcase is made to protrude into the vicinity of the main shaft of the reduction gear mechanism in a manner to correspond to the positions, into which those stud bolts are screwed, whereby the reduction gear mounted on the main shaft, especially, the top gear having the maximum diameter has its outer circumference contacts with that protruding portion. In order to retain a sufficient clearance between that protruding portion and the reduction gear, therefore, it has been necessary to arrange the rear cylinder close to its upright position. With this construction, however, the height of the rear cylinder and accordingly the engine as a whole is so increased as to invite a disadvantage that the accommodation of the engine in the motorcycle having its engine installing space limited is deteriorated.

The present invention has been conceived in view of the background thus far described and contemplates to provide a V-engine which has its overall height reduced so that its installability upon a motorcycle can be improved.

BRIEF DESCRIPTION OF THE INVENTION

In order to attain this contemplation, according to the present invention, the main shaft of a reduction gear mechanism, which is adjacent to the back of a crankshaft, is arranged such that its axis is positioned below the axis of the crankshaft. The present invention will be described in detail in the following with reference to the accompanying drawings.

DETAILED DESCRIPTION OF THE INVENTION

Figure 1:
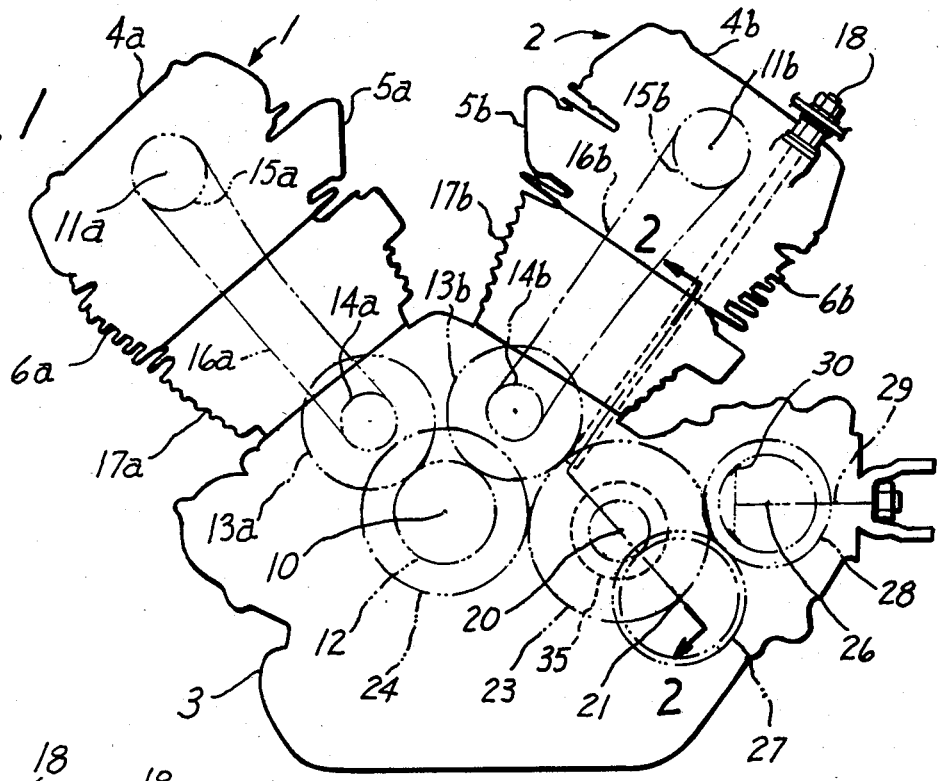
FIG. 1 is a side elevation showing one embodiment of the present invention.

In FIG. 1, reference numerals 1 and 2 indicate a front cylinder and a rear cylinder, respectively, both of which are symmetrically attached to a transversely split crankcase 3. In FIG. 1, specifically, the respective cylinders 1 and 2 have their cylinder heads 4*a* and 4*b* formed with intake ports 5*a* and 5*b* in the facing sides of the respective cylinders 1 and 2 and with exhaust ports 6*a* and 6*b* in the outer sides of the same.

Numeral 10 indicates a crankchaft, and numerals 11*a* and 11*b* indicate overhead cam shafts of the respective cylinders 1 and 2, which are driven by the crankshaft 10. Specifically, gears meshing with a gear 12 made integral with the crankshaft 10 are arranged on the lines joining the crankshaft 10 and the respective cam shafts 11*a* and 11*b*, respectively, and timing chains 16*a* and 16*b* are made to run between sprockets 14*a* and 14*b* made integral with those gears 13*a* and 13*a* and sprockets 15*a* and 15*b* made integral with the aforementioned cam shafts 11*a* and 11*b*. As a result, if the crankshaft 10 rotates in the clockwise direction, as viewed in FIG. 1, the cam shafts 11*a* and 11*b* rotate in the counter-clockwise direction. Incidentally, the number of teeth of the respective gears 12, 13*a* and 13*b* and the respective sprockets 14*a*, 14*b*, 15*a* and 15*b* are so determined that those cam shafts 11*a* and 11*b* rotate at a half speed of that of the crankshaft 10.

Numerals 17*a* and 17*b* indicate cylinder blocks, and numerals 18 and 18 indicate stud bolts which fix the rear portions of the cylinder block 17*b* and the aforementioned cylinder head 4*b* of the rear cylinder 2 to the crankcase 3. Those stud bolts 18 and 18 are screwed deeply into the crankcase 3 through the cylinder head 4*b* and the cylinder block 17*b*. In the respective cylinders 1 and 2, incidentally, there extend a number of stud bolts, all of which are not shown in FIG. 1.

Numerals 20 and 21 indicate main and auxiliary shafts, respectively, both of which form a part of a well-known reduction gear mechanism. This reduction gear mechanism is arranged at the back of the crankshaft 10 such that the main shaft 20 is adjacent to the aforementioned crankshaft 10. The main shaft 20 is rotatably born in the transversely split crankcase 3 such that its axis is positioned below the axis of the crankshaft 10. A known wet type multiple disc clutch 22 is arranged at the right end portion of that main shaft 10, and a gear 24 mounted on the crankshaft 10 is in meshing engagement with a large reduction gear 23 which is attached to the clutch casing of that clutch 22. The main and auxiliary shafts 20 and 21 are equipped with a known reduction gear train 25 so that the rotations of the main shaft 20 are transmitted to the auxiliary shaft 21 through any pair of the gears of the reduction gear train 25. At the back of the auxiliary shaft 21, there is transversely arranged in parallel therewith a shaft 26, to which the rotations of the auxiliary shaft 21 are transmitted through both a gear 27 integrally fixed to the auxiliary shaft 21 and a gear integrally fixed to that shaft 26. Numeral 29 indicates an output shaft which is arranged to intesect the aforementioned shaft 26 at a right angle so that it is rotated by the shaft 26 through a bevel gear 30. The output shaft 29 has its rear end portion protruding backwardly of the crankcase 3 until its protruding portion is connected through a universal joint to a not-shown propeller shaft, by which a rear wheel (although not shown) is driven.

Figure 2:
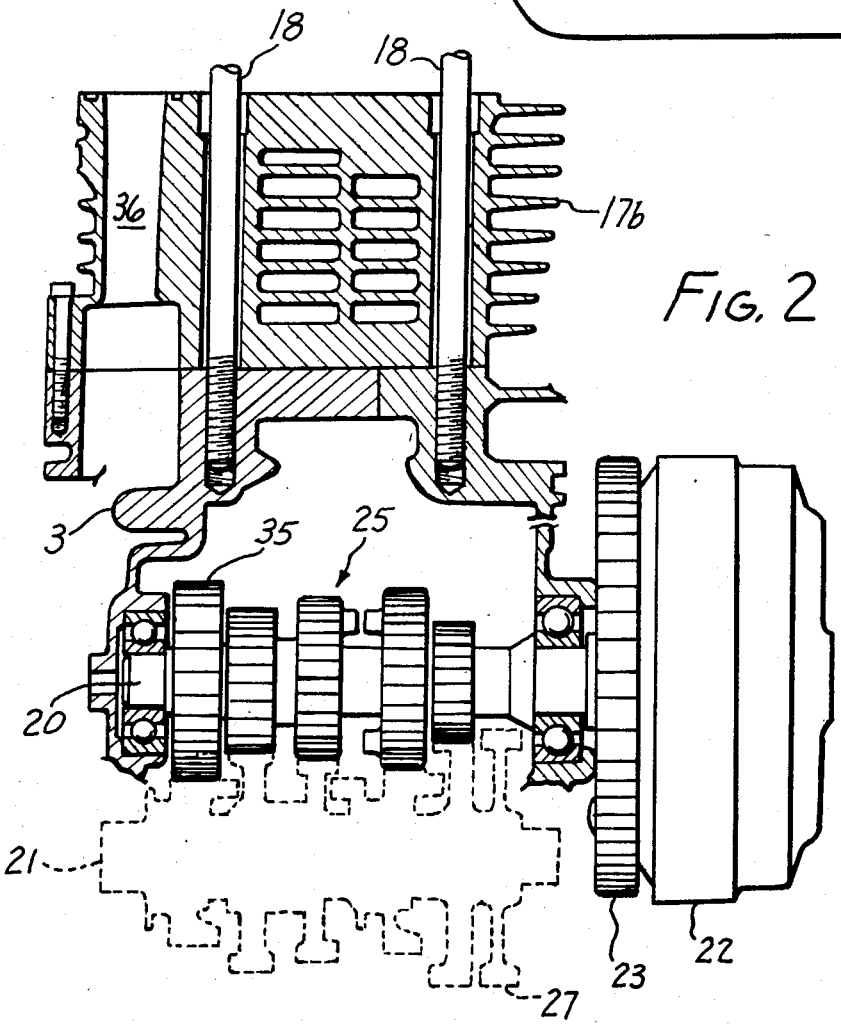
FIG. 2 is a section taken along line II—II of FIG. 1 with its portion being omitted.

Numeral 35 indicates the reduction gear (which is called the "top gear") having the maximum diameter of the reduction gear train which is mounted on the aforementioned main shaft 20. That reduction gear 35 is disposed in the vicinity of the lower end of one of the aforementioned stud bolts 18. The wall portion of the crankcase, into which the lower end of that stud bolt 18, is made so sufficiently thick that it can endure a high strength. Since FIG. 2 is a section of the crankcase 3 taken in the axial direction of the stud bolt 18, a relatively large clearance looks to be formed between the reduction gear 35 and the inner wall of the crankcase 3. Since, however, the crankcase 3 is formed to have an especially large thickness in the circumferential direction of the stud bolt 18, the clearance between the reduction gear 35 and the inner wall of the crankcase 3 is small in fact, as is apparent from FIG. 1.

Incidentally, numeral 36 appearing in FIG. 2 indicates a chain passage which is formed at the lefthand side of the cylinder block **17*b* and in which the aforementioned timing chain 16*b*** is allowed to run.

According to the embodiment thus far described, since the main shaft 20 adjacent to the back of the crankshaft 10 is arranged such that its axis is positioned below the axis of the crankshaft 10, it is possible not only to incline the rear cylinder 2 backwardly at a large angle but also to reduce the space, which is formed between the crankcase 3 above the shaft 26 and the output shaft 29 and the rear cylinder 2, so that the engine as a whole can be assembled further compactly, whereby the installability of the engine upon the motorcycle can be further improved.

As has been described hereinbefore, according to the present invention, since the main axis is arranged such that its axis is positioned below the axis of the crankshaft, it is possible to incline the rear cylinder backward at a large angle, while being required for a limited displacement of the main shaft in the downward direction, so that the overall height of the engine can be remarkably reduced. As a result, the engine can be installed neatly upon the motorcycle, which has its engine installing space restricted in various ways, so that the accommodation of the engine can be made satisfactorily compact.

We claim:

1. In a motorcycle having a forward axis: a V-type internal combustion engine having a crank case with a crank case wall, two cylinders with their axes lying at an angle between planes horizontal to and vertical to the engine, said cylinders, lying in respective vertical planes parallel to the forward axis and forming a V when viewed from a side, and a crank shaft with a laterally extending axis; a transmission having a main shaft with an axis parallel to the crankshaft axis, rearward of it, and below it; and a plurality of stud bolts extending through said cylinders and threaded into the crank case wall, said wall, where the stud bolt approaches said main shaft, being thickened to provide strength for the threads, the orientation of the main shaft relative to the crank shaft enabling the thickness to be provided without interference between crank case and gears on the main shaft.

* * * * *